United States Patent [19]

Alverth et al.

[11] Patent Number: 4,512,564

[45] Date of Patent: Apr. 23, 1985

[54] PULLOUT ROLLER ASSEMBLY

[75] Inventors: Ronald W. Alverth, Lombard; Thomas H. Schumacher, West Chicago, both of Ill.

[73] Assignee: The Mako-Tek Corporation, Downers Grove, Ill.

[21] Appl. No.: 562,854

[22] Filed: Dec. 19, 1983

[51] Int. Cl.[3] ..... B65H 5/06

[52] U.S. Cl. ..... 271/274; 101/228

[58] Field of Search ..... 101/224, 225, 227, 228, 101/246, 231, 232, 181, 183; 271/272, 273, 274

[56] References Cited

U.S. PATENT DOCUMENTS

| | | | |
|---|---|---|---|
| 2,461,376 | 2/1949 | Feldmeier | 271/274 |
| 2,819,078 | 1/1958 | Durand . | |
| 3,022,727 | 2/1962 | Zernor | 101/181 |
| 3,210,074 | 10/1965 | Miaskoff | 271/274 X |
| 3,942,789 | 3/1976 | Townsend | 271/274 |
| 3,947,022 | 3/1976 | Kockler | 271/274 |
| 3,964,739 | 6/1976 | Garcia | 271/274 |
| 4,156,453 | 5/1979 | Scheinecker | 226/194 |
| 4,449,450 | 5/1984 | Barny | 101/183 |

OTHER PUBLICATIONS

Rachui, IBM Technical Disclosure, Printer Paper Bail Rollers, vol. 18, No. 11, Apr. 1976, p. 3537.

*Primary Examiner*—Clyde I. Coughenour
*Assistant Examiner*—William L. Klima
*Attorney, Agent, or Firm*—John J. Kowalik

[57] ABSTRACT

A pullout roller assembly for a printing press comprising an upper roller and a mounting therefor, the mounting including a bellcrank lever having an upright leg and a horizontal leg joined to the upright leg by an elbow. The roller is mounted on a fixed axis of rotation to the elbow and the outer end of the horizontal leg has a ball type universal connection to the frame of the press. The upper end of the upright leg has a pocket formed therein in which a spherical output end of a prime mover is positioned for exerting a force against a flat surface in the pocket without binding for biasing the lever and thus the pullout roller mounted thereon against the periphery of a companion roller, which is normally powered, for grasping a sheet or web of paper passing between the rollers and moving the paper through various stations of the press. The mounting of the lever and the nonbind arrangement the load-transfer joint features and the universal connection permit the pullout roller to float and peripherally conform to the position of the power roller so that both rotate on parallel axes thus avoiding uneven pull on the paper and scuffing and eliminating random sheet lengths.

11 Claims, 4 Drawing Figures

PULLOUT ROLLER ASSEMBLY

BACKGROUND OF THE INVENTION

This invention relates to mechanisms for pulling a web of paper through a printing press. The web is passed through a series of printing components and driers. As each component makes its impression onto the web with wet inks, the web becomes damp. It is mandatory that the web be drawn taut at a constant rate to prevent the web from curling, warping or shrinking or otherwise deforming. Such deformations can be accentuated if the pullout rollers, also known as trolley assemblies, are not accurately positioned to the power rollers toward which the pullout rollers are continuously biased to grasp the paper therebetween. The power rollers are generally of considerable length and several pullout rollers are normally paired with each power roller.

It is not only important to maintain equal pressure between each pair of rollers on the web, but the pairs of rollers must be maintained in parallelism. Otherwise, the non-parallel roller combinations tend to skew the web and to deform the sections of the paper running between them. In sheeting operations random sheet lengths occur if the sheet is not drawn evenly or the sheet is allowed to shrink unevenly.

SUMMARY OF THE INVENTION

This invention pertains to a novel construction of a pullout roller assembly which maintains the pullout roller in parallelism with its paired power roller.

The invention comprehends a novel mounting for a pullout roller which is self-adjusting.

One object of the invention is to provide a novel load transmitting joint for transmitting a force to the pullout roller without binding as the force is applied while the pullout roller is self-adjusting to the periphery of the power roller.

More specifically, the invention provides a novel self-adjusting mounting of simple contruction for delivering pressure loads from a power source so that the pullout roller may position itself in parallelism with the periphery of it companion roller.

The invention further provides a novel mounting for the pullout roller in the form of a bellcrank lever on which the pullout roller is mounted on a fixed horizontal axis to the elbow or the lever, the lever having an upright leg with an upper end providing a vertical surface cooperating with a spherical surface on the output end of a power source, the other leg of the lever extending generally horizontally and being supported on a generally horizontal axis of a ball joint which allows the lever to cant laterally about the contact point between the spherical surface of the power source and the flat surface on the vertical leg of the load-transmitting lever as the pullout roller adjusts itself to position parallel with its companion power roller.

The invention particularly comprehends a novel force-transmitting joint between a stationary power source which has a piston with a ball-shaped end which operates against a flat surface on a pullout-roller-carrying lever, the lever being mounted to swing in an arc about the point of contact between the ball-shaped end of the piston and the flat surface on the lever, the point of contact permitting the lever to swing without binding while load is applied thereto.

It will thus be apparent, that since the ball and surface have only point contact, and the lever being mounted to have universal movement, no binding will occur and the pullout roller which is mounted on the lever is free to adjust automatically to parallel the power roller with which it is mated.

These and other objects inherent in and encompassed by the invention will become more apparent from the specification and the drawings, wherein.

DESCRIPTION OF THE INVENTION

Figures 1, 2, 3, 4:
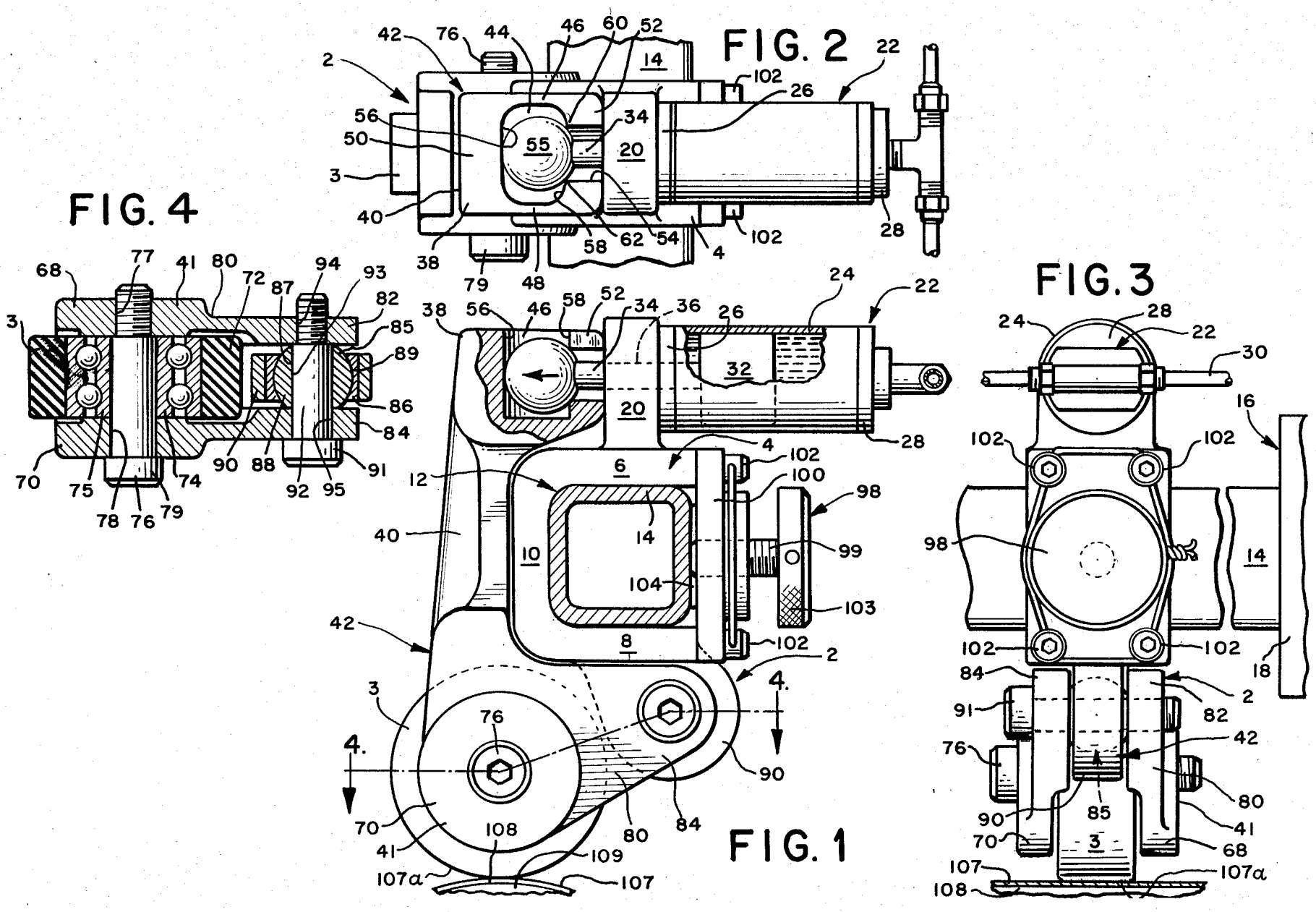
FIG. 1 is a side elevational view partly in vertical section of the novel pullout roller assembly illustrated mounted on a press frame member shown in cross-section and associated with a power roller fragmentarily shown.
FIG. 2 is a top view of the structure shown in FIG. 1.
FIG. 3 is an end elevational view of the structure shown in FIG. 1.
FIG. 4 is a cross-sectional view taken substantially on line 4—4 of FIG. 1.

Describing the invention in detail and having particular reference to the drawings, there is illustrated the novel mounting assembly 2 for a pullout roller 3.

The assembly 2 comprises a U-shaped bracket 4 having top and bottom horizontal legs 6 and 8 and a vertical bight portion 10 (FIG. 1). The bracket defines a jaw 12 which embraces a complementary, normally horizontally positioned, square box-shaped beam 14 which forms part of the press frame 16 and is suitably connected at each end to a side frame 18 of the press. It will be understood that there is a side frame at each side of the press which normally is bolted to or otherwise secured to the floor of the building in which the press is housed.

The bracket 4 has a lug 20 projecting vertically from the upper side of its top leg and the lug 20 extends widthwise transversely to a power source or prime mover generally designated 22, which comprises an air cylinder 24 which has a plug connection 26 at one end with the lug 20 and at its other end is provided with a closure or cap 28 mounting an air pressure line 30 which feeds air under pressure through a suitable fitting and porting in the cap 28 into the cylinder 24. Although an air line is preferred it is apparent that other fluids may be used. The pressure fluid is introduced into the cylinder between the cap 28 and an opposing side of a piston head 32 which reciprocates within the cylinder and drives a stem or shaft 34 connected thereto. The piston stem 34 projects through a guide opening in member 26 and through an opening 36 in lug 20 and into the upper end portion 38 of a vertical leg 40 of a pullout-roller-mounting bellcrank lever 42.

The upper end portion of the leg 40 is formed with a rectangular straight-sided pocket which is open at its upper end and is defined by inner, outer and lateral side walls 46,48,50 and 52, respectively.

The inner wall is formed with vertical slot 54 open at the top and admits the piston stem 34 therethrough. A sphere or ball 55 is fastened on the free end of the stem 34 and has a diameter slightly larger than the space between the fore and aft faces 56,58 on the inner sides of the front and rear walls of the pocket. The corner edges 60,62 formed at the juncture of the sides of the slot 54 and the portions of the adjacent sections of the face 58 on the respective portions of the rear wall may be chamfered or the slot may be made wide enough to accommodate the opposing sector of the sphere so long as the sphere may easily move up and down and rock within the pocket but cannot pass through the slot.

It will be noted that the side faces of the pocket are spaced laterally outwardly from the respective sides of the sphere. The sphere has tangential point contact with the flat face 56 and may slide up and down thereon attendant to the lever swinging vertically about its axis of pivot as will be presently described.

The leg 40 extends downwardly from its upper end in front of the bight portion 10 of the supporting bracket, and at its lower end joins the elbow section 41 of the lever, which is furcated and between its furcations 68,70 mounts the pullout roller 3.

The roller 3 has a body 72 into which there is pressed a ball bearing 74 which comprisies an inner race 75 which complementally fits onto the shank of a horizontal mounting pin or bolt 76. The shank is threaded at one end into a threaded opening 77 in one of the furcations 68 and extends through an aligned opening 78 in the other furcation 70. The head 79 of the bolt, when tightened, bears against the external side of furcation 70.

The lever has a horizontal leg 80 which extends under the lower leg 8 of the mounting bracket 4 (FIG. 1) and as best seen in FIG. 4 is formed by a pair of furcations 82,84 which continue from the furcations 68,70, respectively, and at their rear ends embrace a ball joint 85.

The ball joint comprises a cylindrical sleeve 86 and an encompassing spherical socket into which a ball 88 of complimentary diameter is fitted for universal movement therein. The sleeve 86 is pressed into a horizontal bore 89, which extends generally parallel with the axis of the pin 76. Bore 89 is formed in an integral ear 90 depending from the underside of the bottom leg of the mounting bracket.

A bolt or pin 91 has its shank 92 extending through a complimentary bore 93 extending diametrically through the ball 88 and the ends of the pin extend through laterally aligned openings 94,95 in the furcations 82,84, one end of the bolt being threaded into the opening 94 and the other end being formed with a head 96 which tightly engages the external side of the furcation 84.

The assembly 2 may be moved along the support bat or beam 14 and slightly secured in selected position by locking clamp 98 which has a shank 99 threaded through reinforcing plate 100 which is secured by bolts 102 to the free edges of legs 6,8 of the mounting bracket. A pressure pad 104 is provided on the inner end of the shank or screw 9 and a disk type handle 103 is provided on the outer end of the locking screw 99 so that the screw may be tightened to retain the assembly in place or loosened to reposition it.

It will be noted that the pressure at the periphery 107*a* of the free rolling pullout roller is governed by the pressure in the cylinder so as to hold the sheet or web 107 pressed against the periphery 108 of the driving roller 109, which as well understood by those skilled in the art is mounted on a fixed horizontal axis from the press frame and is driven by an electric motor (not shown).

Each driving roller is several feet in length and parallelism between the driving roller and each of the several pullout rollers associated therewith has been heretofore difficult, if not impossible, to maintain or obtain.

The instant invention permits the lever and the pullout roller mounted thereon to have universal movement and thus the opposing cylindrical areas between each pullout roller and its companion power roller is automatically adjusted so that the axis of rotation of both rollers will be parallel.

Also, as the lever moves up or down about its universal mounting, a point contact is maintained between the load transmitting surface at the upper end of the vertical leg of the lever and lateral as well as fore and aft floating and canting of the lever and its pullout roller is accommodated. As the lever moves up and down the contact is along a thin line. Sliding or scuffing of the paper between the mating rollers is eliminated and the web proceeds unimpeded through the rollers.

Having described a preferred enbodiment of the invention, it will be noted that various modifications will become apparent to those skilled in the art which are intended to fall within the scoped of the following appended claims.

We claim:

1. In a printing press comprising frame means supporting a plurality of imprinting stations and means for drawing imprintable stock through said stations comprising stock-grasping and pulling roller means mounted on said frame means said roller means comprising a first roller rotatable about a fixed axis, a second roller, means mounting said second roller for adjustment about a single universal axis defined between a point of contact of an associated biasing means, and a point at the center of a cross section of the second roller for automatically adapting said second roller to position itself to rotate about an axis parallelling said fixed axis of said first roller, and rigid non-binding load transfer means having a single point of contact with said mounting means for biasing said second roller toward the fist roller and providing an axis of pivot for said mounting means about said universal axis without inhibiting self-adjustment thereof for grasping said stock therebetween.

2. The invention according to claim 1 and said means mounting said second roller comprising a member supporting said second roller thereon on a fixed axis of rotation generally paralleling said fixed of rotation of the first roller.

3. The invention according to claim 1 and said non-binding load-transfer means comprising a ball and engaging tangential surface for transmitting loads from said load transfer means to said member.

4. The invention according to claim 1 and said mounting means comprising a lever rotatably supporting intermediate its ends said second roller for rotation on an axis generally paralleling that of the first roller, a prime mover having an operable connection through said non-binding load transfer means to one end of said lever for biasing the lever with said second roller toward the first roller, and means universally mounting the lever at its other end for accommodating tilting of the second roller about said single axis into a position paralleling the first roller.

5. In a printing press comprising frame means supporting a plurality of impriting stations and means for drawing imprintable stock through said stations comprising stock-grasping and pulling roller means mounted on said frame means, said roller means comprising a first roller rotatable about a fixed axis, a second roller, and means mounting said second roller for rotation about a self-adjusting axis for adapting said second roller to rotate about an axis paralleling said fixed axis of the first roller and non-binding load transfer means for biasing said second roller toward the first roller without inhibiting self-adjustment thereof for grasping said stock therebetween, and said mounting means comprising a lever rotatably supporting intermediate its ends said second roller for rotation on an axis generally paralleling that of the first roller, a prime mover having an operable connection through said non-binding load transfer means to one end of said lever for biasing the lever with said second roller toward the first roller, and means universally mounting the lever at its other end for accommodating tilting of the second roller about a single axis into a position paralleling the first roller, and said operable connection between the prime mover and lever comprising a pocket in said lever having a flat wall surface and means held captive in said pocket providing a force output from said prime mover and having a spherical face opposing said face surface and in tangential contact therewith.

6. A pullout roller assembly for drawing paper stock and the like comprising:

a support, a roller mounted for rotation on said support, a single self-adjusting universal means 85 for mounting said support and providing universal movement of said support with said roller and rigid means for transmitting biasing loads therethrough to said support at a single point while accommodating concurrent universal movement of said support with said roller.

7. The invention according to claim 6 and said load transmitting means comprising a connecting element presenting a curved thrust face, and an opposing surface on said support in tangential contact with said face.

8. The invention according to claim 7 and said support member comprising a bellcrank lever having an upright leg and a horizontal leg and an elbow interconnecting said legs, said roller being mounted on said elbow, and said single universal means and said means for transmitting biasing loads being disposed on the outer ends of respective legs.

9. The invention according to claim 6 and said transmitting means comrising a load-transfer connection comprising a socket in said support, and an articulate joint therein.

10. The invention according to claim 9 and said socket having a load-receiving face and a slot opposite the the face, and load thrusting means extending through said slot and in point contact with said face.

11. The invention according to claim 6 and said support comprising a lever pivoted at one end on said single universal means and swingable for movement to and from an associated power roller, and said means for transmitting biasing loads comprising a ball and a receiving socket therefor at the other end of the lever having a surface for receiving thrust loads from the ball at a single point for accommodating lateral and pivotal movements of the lever about said single universal means.

* * * * *